US010322923B2

(12) United States Patent
Huang

(10) Patent No.: US 10,322,923 B2
(45) Date of Patent: Jun. 18, 2019

(54) BEER DISPENSER

(71) Applicant: Hainan Chain Solutions Industrial Company Limited, Hainan Province (CN)

(72) Inventor: Shengyong Huang, Hainan Province (CN)

( * ) Notice: Subject to any disclaimer, the term of this patent is extended or adjusted under 35 U.S.C. 154(b) by 36 days.

(21) Appl. No.: 15/712,137

(22) Filed: Sep. 22, 2017

(65) Prior Publication Data

US 2018/0370785 A1 Dec. 27, 2018

(30) Foreign Application Priority Data

Jun. 22, 2017 (CN) ..... 2017 2 0735425 U

(51) Int. Cl.
*B67D 1/04* (2006.01)
*B67D 1/12* (2006.01)
*B67D 1/08* (2006.01)

(52) U.S. Cl.
CPC ..... *B67D 1/0406* (2013.01); *B67D 1/0425* (2013.01); *B67D 1/0888* (2013.01); *B67D 1/1277* (2013.01)

(58) Field of Classification Search
CPC .. B67D 1/0406; B67D 1/0425; B67D 1/0888; B67D 1/1277
USPC ..... 222/394, 399, 333–334, 400.5
See application file for complete search history.

(56) References Cited

U.S. PATENT DOCUMENTS 342,733 A * 5/1886 Collins ..... B65D 83/70 222/397
353,723 A * 12/1886 Weatherhead ..... A47G 19/24 222/173
374,232 A * 12/1887 Babcock ..... A47G 19/24 222/173
460,260 A * 9/1891 Fowler ..... A61M 15/009 222/36
565,615 A * 8/1896 Grossman ..... F16N 13/16 222/334
2,147,862 A * 2/1939 Sollinger ..... B67D 1/04 141/45
2,272,443 A * 2/1942 Tamminga ..... G01F 13/00 222/195
3,251,420 A * 5/1966 Rodgers ..... A62C 13/006 169/77
3,434,632 A * 3/1969 Batrow ..... B67D 1/0412 222/400.5

(Continued)

*Primary Examiner* — Paul R Durand
*Assistant Examiner* — Andrew P Bainbridge
(74) *Attorney, Agent, or Firm* — Prakash Nama; Global IP Services, PLLC

(57) ABSTRACT

A novel beer dispenser, including a base, a main body and a cap; a receiving cavity is provided inside the main body. The receiving cavity accommodates a beer container. The main body is disposed on the base and has a bottom portion which communicates with the base. A base cup is provided inside the base. The base cup has a sealing flange on top. The base cup receives a bottom portion of the beer container. The main body has a top portion which is disposed with an air pump receiving cavity. An air pump is disposed inside the air pump receiving cavity. The cap is disposed at the top portion of the main body. The present invention is divided into three parts, namely the base, the main body and the cap. Such reasonable structure facilitates both assembly and cleaning.

5 Claims, 5 Drawing Sheets

(56) References Cited

U.S. PATENT DOCUMENTS

| | | | | |
|---|---|---|---|---|
| 7,234,240 | B2 * | 6/2007 | Peter | B26B 19/40 222/400.5 |
| 7,882,986 | B2 * | 2/2011 | Huang | B05B 9/0805 222/209 |
| 8,505,442 | B2 * | 8/2013 | Ishida | B67D 1/0071 222/14 |
| 9,193,577 | B2 * | 11/2015 | McIntyre | B67D 1/04 |
| 9,284,177 | B2 * | 3/2016 | Litto | B67D 1/0431 |
| 9,895,667 | B2 * | 2/2018 | McDonald | B01F 11/0241 |
| 2006/0175355 | A1 * | 8/2006 | Glucksman | B67D 1/0425 222/209 |
| 2010/0059548 | A1 * | 3/2010 | Smid | B67D 1/0431 222/146.6 |
| 2010/0314411 | A1 * | 12/2010 | Tuyls | B67D 7/02 222/144.5 |
| 2014/0097201 | A1 * | 4/2014 | Otto | B67D 3/00 222/95 |
| 2017/0266630 | A1 * | 9/2017 | McDonald | B01F 3/04446 |
| 2018/0370785 | A1 * | 12/2018 | Huang | B67D 1/0406 |

* cited by examiner

BEER DISPENSER

BACKGROUND OF THE INVENTION

The present invention relates to a novel beer dispenser and belongs to the field of beer production apparatus.

Beer is the oldest alcoholic beverage in human history. It ranks the third in terms of beverage consumption after water and tea. Beer was introduced to China in the early $20^{th}$ century as an imported alcoholic beverage. The Chinese terminology for "beer" was derived from the English word "beer" and has been in use till now. The major ingredients of beers are barley malt, hops and water, which are fermented with yeast to brew a low alcoholic beverage with carbon dioxide. Some beers after opened have a poor mouthfeel especially in summer, yet there are few apparatus for improving beer mouthfeel in the marketplace.

BRIEF SUMMARY OF THE INVENTION

In view of the aforesaid disadvantages now present in the prior art, the present invention provides a novel beer dispenser.

To attain this, the present invention comprises a base, a main body and a cap. A receiving cavity is provided inside the main body. The receiving cavity accommodates a beer container. The main body is disposed on the base and has a bottom portion which communicates with the base. A base cup is provided inside the base. The base cup has a sealing flange on top. The base cup receives a bottom portion of the beer container. The main body has a top portion which is disposed with an air pump receiving cavity. An air pump is disposed inside the air pump receiving cavity. The cap is disposed at the top portion of the main body. A battery seat, a battery cap, batteries, a control PCB, a cathode spring plate and an ultrasonic oscillator are disposed inside the cap. The battery cap and the battery seat are disposed inside the cap at a top side and a bottom side thereof respectively. The cathode spring plate and the ultrasonic oscillator are disposed on the battery seat. The battery cap is provided with a battery receiving cavity. The batteries are disposed inside the battery receiving cavity. The control PCB is disposed between the battery cap and the battery seat. A beer faucet is provided at an outer side of the cap. A control handle is provided at an outer side of the beer faucet. A handle driving assembly is provided inside the beer faucet. An air valve assembly is provided at an inward facing end of the beer faucet. The handle driving assembly and the air valve assembly are connected with each other.

Preferably, the air valve assembly comprises an air valve switch, a silicone air valve, an air valve connecting member and a gas releasing spring. The air valve switch has a top portion which is connected to the handle driving assembly. The silicone air valve is disposed at a bottom portion of the air valve switch. The gas releasing spring is disposed at a bottom portion of the silicone air valve. The air valve connecting member passes through the silicone air valve and connects to the air valve switch.

Preferably, a beer hose is provided inside the main body. The beer hose has two ends which are respectively disposed inside the beer container and on an outward facing end of the beer faucet.

Preferably, the air pump receiving cavity has a bottom portion which is provided with a gas charging opening.

Preferably, a protective cap is provided at a top portion of the cap. An anode spring plate is disposed on a bottom portion of the protective cap.

Preferably, the base comprises a base casing and a silicone pad. A base cup receiving cavity for receiving the base cup is provided inside the base casing. The base cup receiving cavity extends from a top end to a bottom end of the base casing. The base cup is secured at a top end of the base cup receiving cavity by screws. The silicone pad seals a bottom end of the base cup receiving cavity.

The beneficial effects of the present invention are mainly as follows:

The present invention is divided into three parts, namely the base, the main body and the cap. Such reasonable structure facilitates both assembly and cleaning, improves mouthfeel of the beer stored inside. With the addition of the air valve assembly, the present invention ensures that the beer would not remain in the beer hose, thus eliminating any impact on subsequent dispensing of the beer.

BRIEF DESCRIPTION OF THE DRAWINGS

The drawings are used to provide a better understanding of the present invention and form part of the description. The embodiment of the present invention and the drawings are used for describing the present invention but do not limit the scope of the present invention.

In the drawings.

Figure 1:
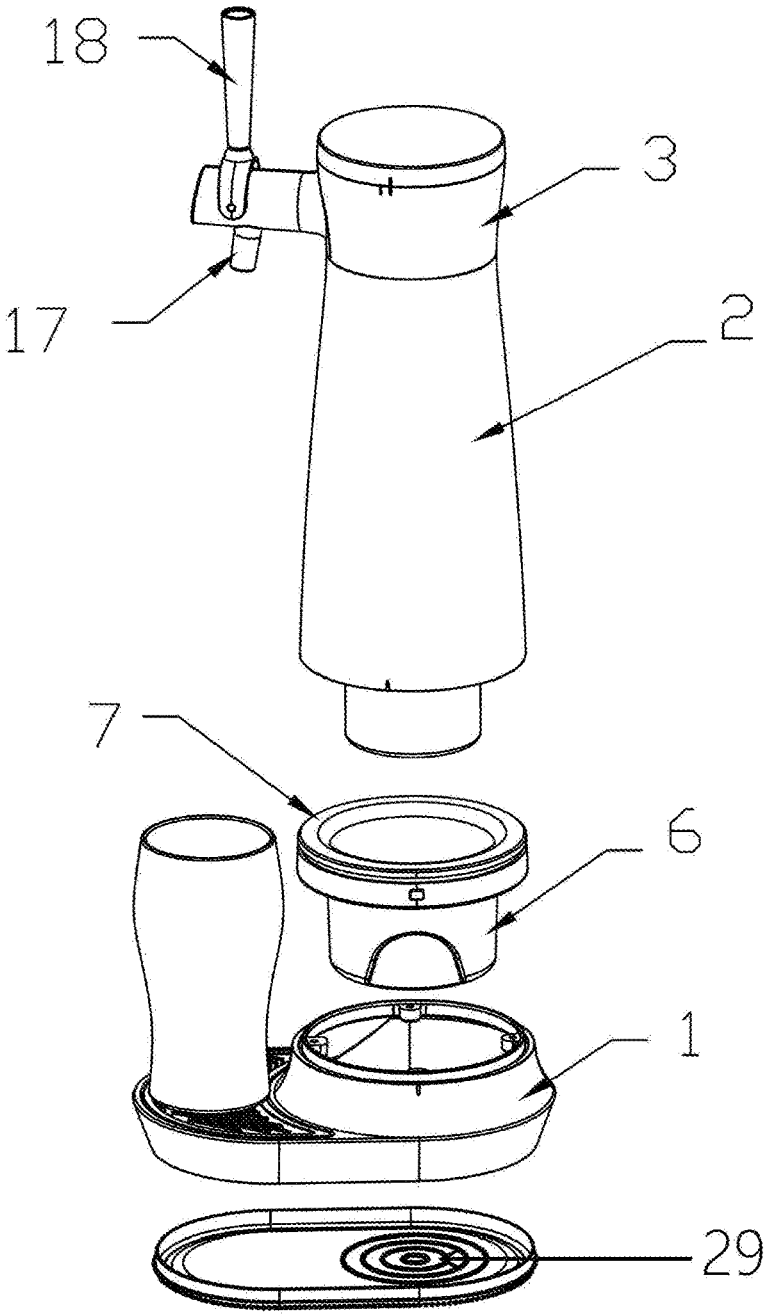
FIG. 1 is a schematic view showing the external structure of the novel beer dispenser of the present invention.

In the drawings: 1 denotes the base casing; 2 denotes the main body; 3 denotes the cap; 4 denotes the receiving cavity; 5 denotes the beer container; 6 denotes the base cup; 7 denotes the sealing flange; 8 denotes the battery seat; 9 denotes the battery cap; 10 denotes the batteries; 11 denotes the air pump; 12 denotes the control PCB; 13 denotes the anode spring plate; 14 denotes the cathode spring plate; 15 denotes the ultrasonic oscillator; 16 denotes the battery receiving cavity; 17 denotes the beer faucet; 18 denotes the control handle; 19 denotes the handle driving assembly; 20 denotes the air valve assembly; 21 denotes the air valve switch; 22 denotes the silicone air valve; 23 denotes the air valve connecting member; 24 denotes the gas releasing spring; 25 denotes the beer hose; 26 denotes the air valve receiving cavity; 27 denotes the gas charging opening; 28 denotes the protective cap; 29 denotes the silicone pad.

DETAILED DESCRIPTION OF THE INVENTION

The present invention will be described with a preferred embodiment and the accompanying drawings. It should be understood that the preferred embodiment described herein is used for describing and explaining the present invention and does not limit the scope of the present invention.

Embodiment

Figure 2:
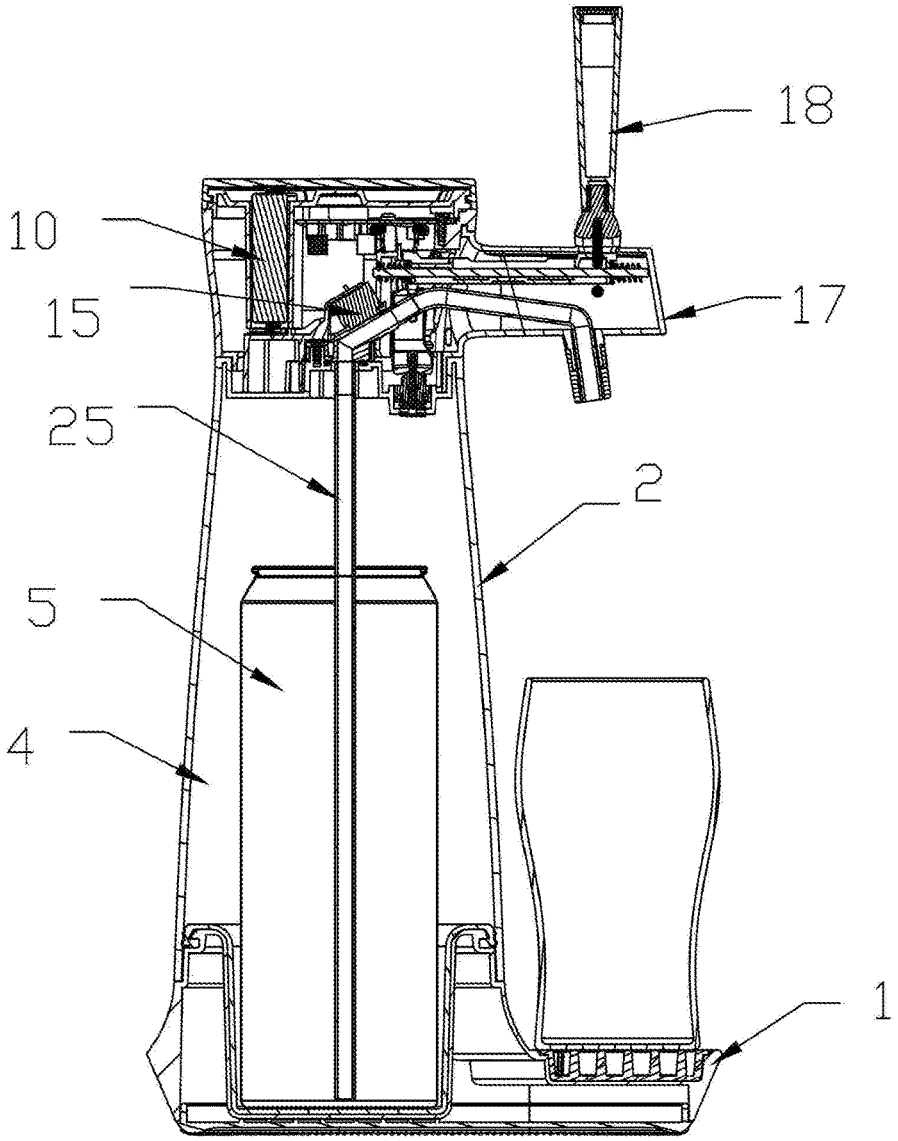
FIG. 2 is a schematic view showing the internal structure of the novel beer dispenser of the present invention.
Figure 3:
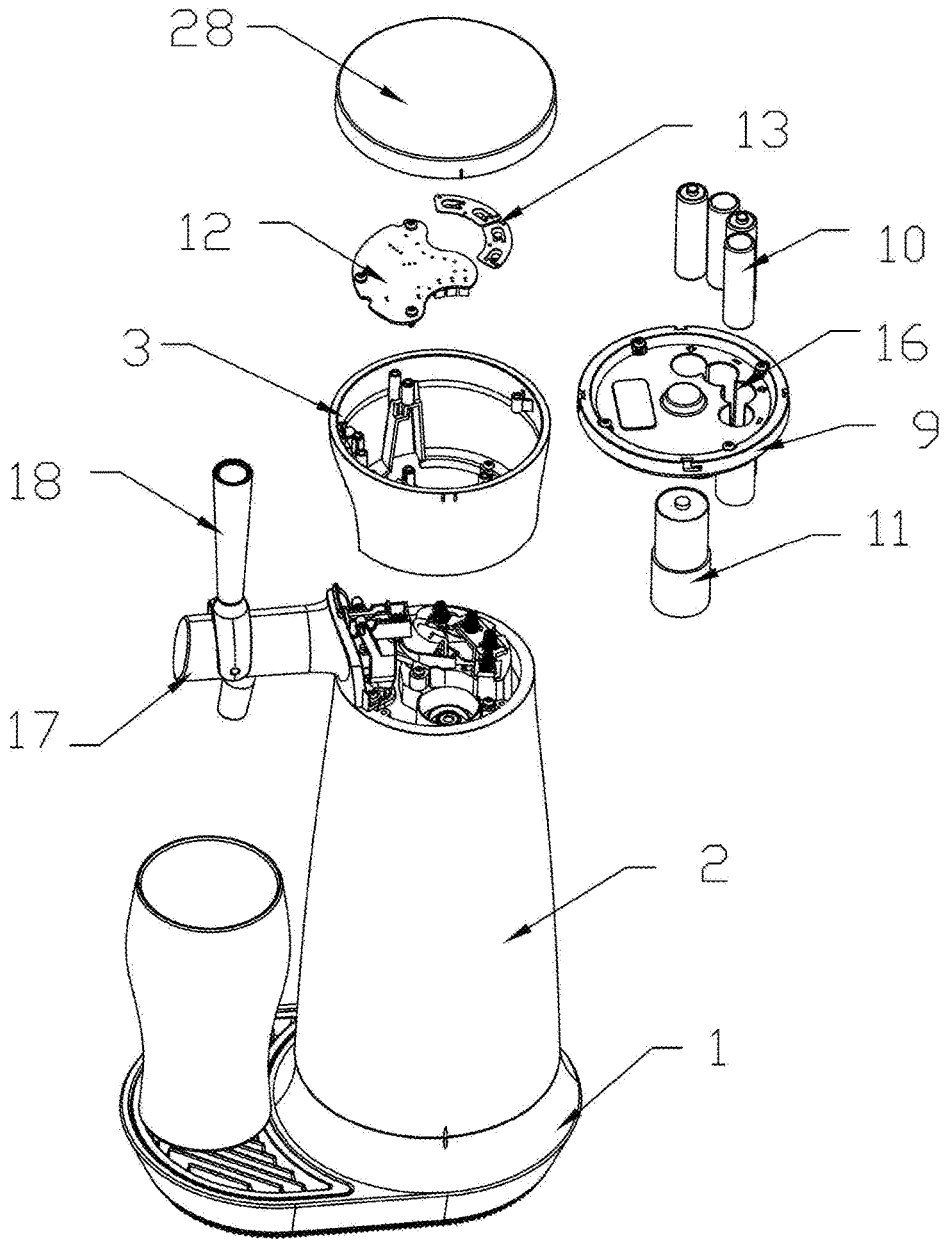
FIG. 3 is a disassembling view of the novel beer dispenser of the present invention.
Figure 4:
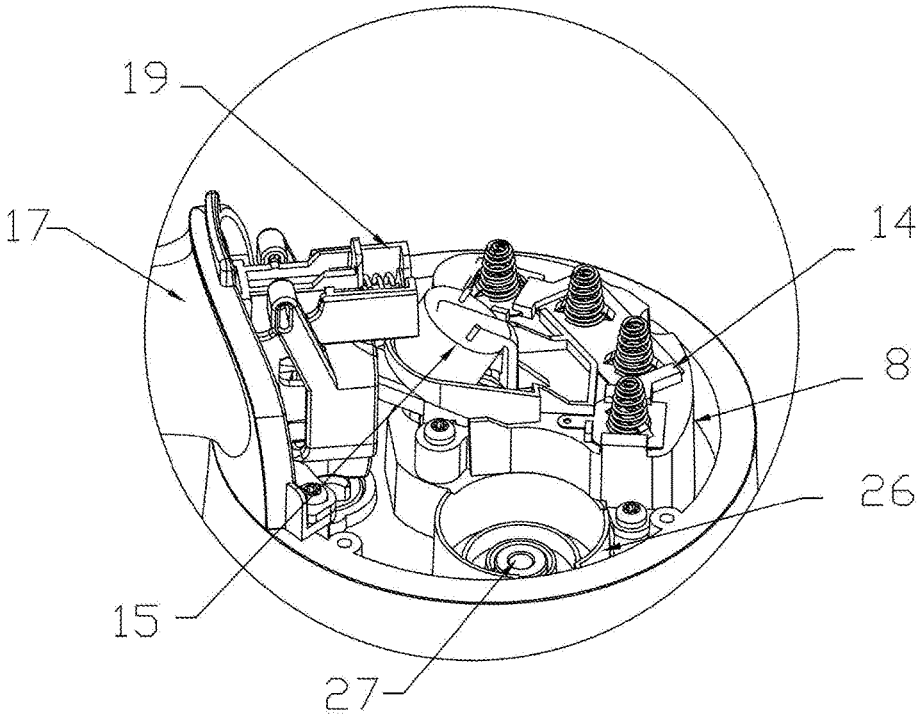
FIG. 4 is a partial enlarged view of the novel beer dispenser of the present invention.
Figure 5:
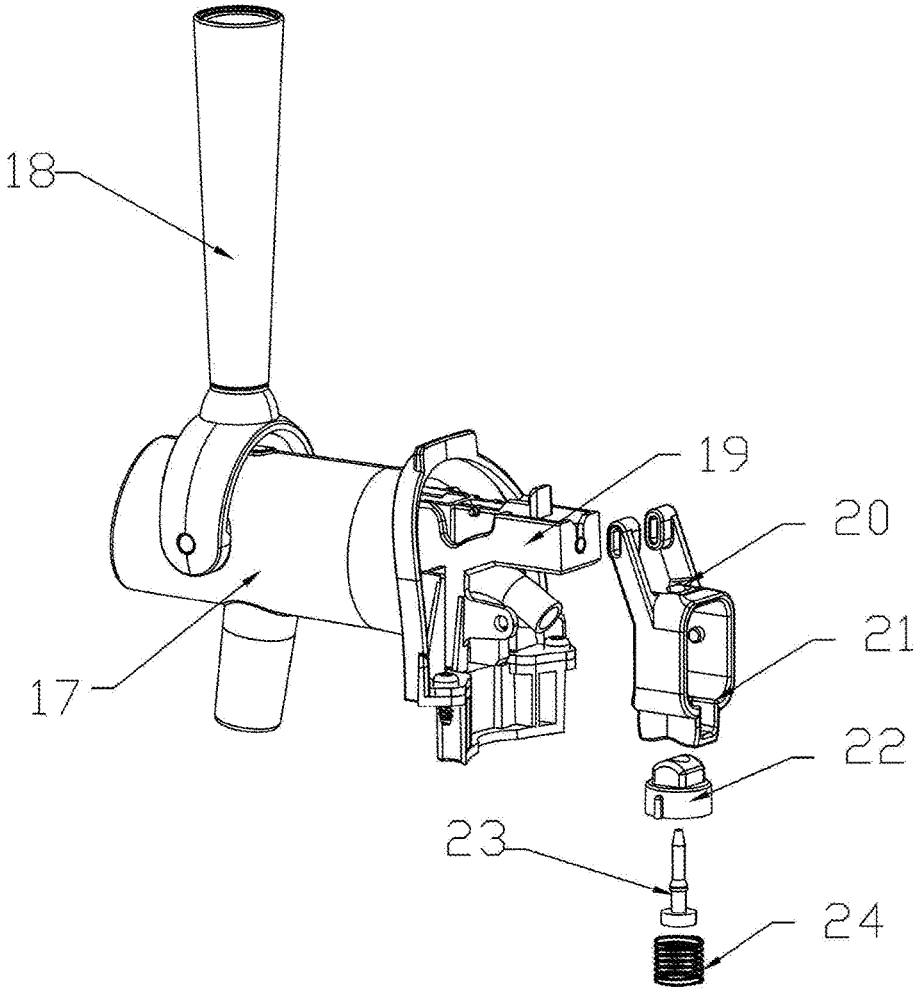
FIG. 5 is a schematic view showing the structure of the air valve components of the present invention.

As illustrated in FIGS. 1-5, the novel beer dispenser comprises a base, a main body 2 and a cap 3. A receiving cavity 4 is provided inside the main body 2. The receiving cavity 4 accommodates a beer container 5. The main body 2 is disposed on the base and has a bottom portion which communicates with the base. A base cup 6 is provided inside the base. The base cup 6 has a sealing flange 7 on top. The base cup 6 receives a bottom portion of the beer container 5. The main body 1 has a top portion which is disposed with an air pump receiving cavity 26. An air pump 11 is disposed inside the air pump receiving cavity 26. The cap 3 is disposed at the top portion of the main body 1. A battery seat 8, a battery cap 9, batteries 10, the air pump 11, a control PCB 12, an anode spring plate 13, a cathode spring plate 14 and an ultrasonic oscillator 15 are disposed inside the cap 3. The battery cap 9 and the battery seat 8 are disposed inside the cap 3 at a top side and a bottom side thereof respectively. The air pump, the cathode spring plate 14 and the ultrasonic oscillator 15 are disposed on the battery seat 8. The battery cap 9 is provided with a battery receiving cavity 16. The batteries 10 are disposed inside the battery receiving cavity 16. The control PCB 12 is disposed between the battery cap 9 and the battery seat 8. The anode spring plate 13 is disposed on a top side of the battery cap 9. A beer faucet 17 is provided at an outer side of the cap 3. A control handle 18 is provided at an outer side of the beer faucet 17. A handle driving assembly 19 is provided inside the beer faucet 17. An air valve assembly 20 is provided at an inward facing end of the beer faucet 17. The handle driving assembly 19 and the air valve assembly 20 are connected with each other.

The air valve assembly 20 comprises an air valve switch 21, a silicone air valve 22, an air valve connecting member 23 and a gas releasing spring 24. The air valve switch 21 has a top portion which is connected to the handle driving assembly 19. The silicone air valve 22 is disposed at a bottom portion of the air valve switch 21. The gas releasing spring 24 is disposed at a bottom portion of the silicone air valve 22. The air valve connecting member 33 passes through the silicone air valve 22 and connects to the air valve switch 21 to ensure proper functioning of the air valve assembly 20. A beer hose 25 is provided inside the main body 2. The beer hose 25 has two ends which are respectively disposed inside the beer container 5 and an outward facing end of the beer faucet 17. The air pump receiving cavity 26 has a bottom portion which is provided with a gas charging opening 27 for facilitating the air pump 11 to pump gas into the receiving cavity 4 to drive beer to flow out from the beer hose 25. A protective cap 28 is provided at a top portion of the cap 3. The anode spring plate 13 is disposed on a bottom portion of the protective cap 28.

In the present invention, the base comprises a base casing 1 and a silicone pad 29. The base casing 1 is provided with a base cup receiving cavity for receiving the base cup 6. The base cup receiving cavity extends from a top end to a bottom end of the base casing. The base cup is secured at a top end of the base cup receiving cavity by screws. The silicone pad 29 seals a bottom end of the base cup receiving cavity.

Operating Principle:

First, the beer container 5 is positioned on the base cup 6. The main body 2 is then connected to the base 1 and one end of the beer hose 25 is inserted into the beer container 5. To dispense the beer, simultaneously activate the air pump 11 and the ultrasonic oscillator 15. The air pump 11 pumps gas into the receiving cavity 4 to drive beer in the beer container to flow out from the beer hose 25. The ultrasonic oscillator 15 performs high frequency oscillation to the beer flowing out from the beer hose 25 to foam the beer to improve mouthfeel. To stop dispensing the beer, simultaneously stop the air pump 11 and the ultrasonic oscillator 15. The silicone air valve 22 moves upward by the force of the gas releasing spring 24 to discharge gas inside the receiving cavity 4, thus preventing the beer from remaining in the beer hose 25.

It should be noted that the above preferred embodiment does not limit the scope of the present invention. Although the present invention is described in detail in reference to the above embodiment, those skilled in the art may still make modifications or substitutions to the technical scheme as described in the above embodiment. Any modifications, substitutions, improvements and so forth not deviated from the spirit of the present invention fall within the scope of the present invention.

What is claimed is:

1. A novel beer dispenser comprising a base, a main body (2) and a cap (3), wherein the main body (2) is disposed on the base and has a bottom portion which communicates with the base, and the cat (3) is disposed at a top portion of the main body (2); the beer dispenser further comprising:

a receiving cavity (4) provided inside the main body (2);

a base cup (6) provided inside the base;

an air pump receiving cavity (26) disposed at the top portion of the main body (2);

an air pump (11) disposed inside the air pump receiving cavity (26);

a battery seat (8), a battery cap (9), batteries (10), a control PCB (12), a cathode spring plate (14) and an ultrasonic oscillator (15) disposed inside the cap (3); wherein the battery cap (9) and the battery seat (8) are disposed inside the cap (3) at a top side and a bottom side thereof respectively; the cathode spring plate (14) and the ultrasonic oscillator (15) are disposed on the battery seat (8); the battery cap (9) is provided with a battery receiving cavity (16); the batteries (10) are disposed inside the battery receiving cavity (16); the control PCB (12) is disposed between the battery cap (9) and the battery seat (8);

a beer faucet (17) provided at an outer side of the cap (3);

a control handle (18) provided at an outer side of the beer faucet (17);

a handle driving assembly (19) provided inside the beer faucet (17); and an air valve assembly (20) provided at an inward facing end of the beer faucet (17); wherein the handle driving assembly (19) and the air valve assembly (20) are connected with each other; the air valve assembly (20) comprises an air valve switch (21), a silicone air valve (22), an air valve connecting member (23) and a gas releasing spring (24); the air valve switch (21) has a top portion which is connected to the handle driving assembly (19); the silicone air valve (22) is disposed at a bottom portion of the air valve switch (21); the gas releasing spring (24) is disposed at a bottom portion of the silicone air valve (22); the air valve connecting member (33) passes through the silicone air valve (22) and connects to the air valve switch (21).

2. The novel beer dispenser as in claim 1, characterized in that a beer hose (25) is provided inside the main body (2); the beer hose (25) has two ends which are respectively disposed inside the beer container (5) and on an outward facing end of the beer faucet (17).

3. The novel beer dispenser as in claim 1, characterized in that the air pump receiving cavity (26) has a bottom portion which is provided with a gas charging opening (27).

4. The novel beer dispenser as in claim 1, characterized in that a protective cap (28) is provided at a top portion of the cap (3); an anode spring plate (13) is disposed on a bottom portion of the protective cap (28).

5. The novel beer dispenser as in claim 1, characterized in that the base comprises a base casing (1) and a silicone pad (29); a base cup receiving cavity for receiving the base cup (6) is provided inside the base casing (1); the base cup receiving cavity extends from a top end to a bottom end of the base casing; the base cup is secured at a top end of the base cup receiving cavity by screws; the silicone pad (29) seals a bottom end of the base cup receiving cavity.

* * * * *